US005813929A

United States Patent [19]

Tobin

[11] Patent Number: 5,813,929

[45] Date of Patent: Sep. 29, 1998

[54] PORTABLE HOOP AND BACKGROUND ASSEMBLY

[76] Inventor: Matthew Tobin, 4526 Boone St., Philadelphia, Pa. 19128

[21] Appl. No.: 767,215

[22] Filed: Dec. 16, 1996

[51] Int. Cl.[6] ..... A63B 63/02

[52] U.S. Cl. ..... 473/485; 473/481

[58] Field of Search ..... 473/479, 480, 473/481, 482, 483, 485, 100, 101

[56] References Cited

U.S. PATENT DOCUMENTS

| | | | |
|---|---|---|---|
| 1,539,541 | 5/1925 | Burns | 40/607 |
| 2,517,463 | 8/1950 | Cobb | 473/481 |
| 3,669,450 | 6/1972 | Mason | 473/483 |
| 3,729,847 | 5/1973 | Chandos | 40/607 X |
| 3,820,784 | 6/1974 | Boitano et al. | 473/481 |
| 3,964,743 | 6/1976 | Salsich, Sr. | 473/481 |
| 4,036,494 | 7/1977 | Hayes | 473/481 |
| 4,941,661 | 7/1990 | Lykens | 473/483 |
| 4,974,841 | 12/1990 | Jarriel et al. | 473/483 |
| 5,014,983 | 5/1991 | Saunders | 473/483 |
| 5,054,219 | 10/1991 | Hoyt et al. | 40/607 X |

FOREIGN PATENT DOCUMENTS

| | | | |
|---|---|---|---|
| 109945 | 4/1900 | Germany | 40/145 |

*Primary Examiner*—Raleigh W. Chiu

[57] ABSTRACT

A new Portable Hoop and Backboard Assembly that is easily installed and disassembled. The inventive device includes a rim, a light weight backboard that is equipped with bendable protrusions to stabilize the assembly, straps for attaching the backboard, and a rim that is collapsible.

7 Claims, 3 Drawing Sheets

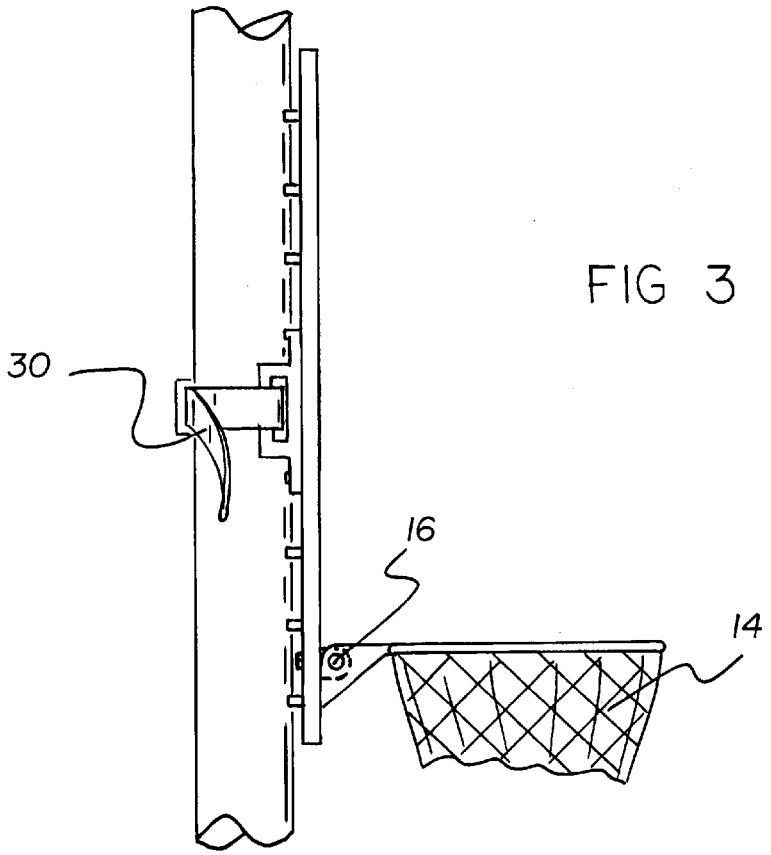
FIG 3
FIG 4
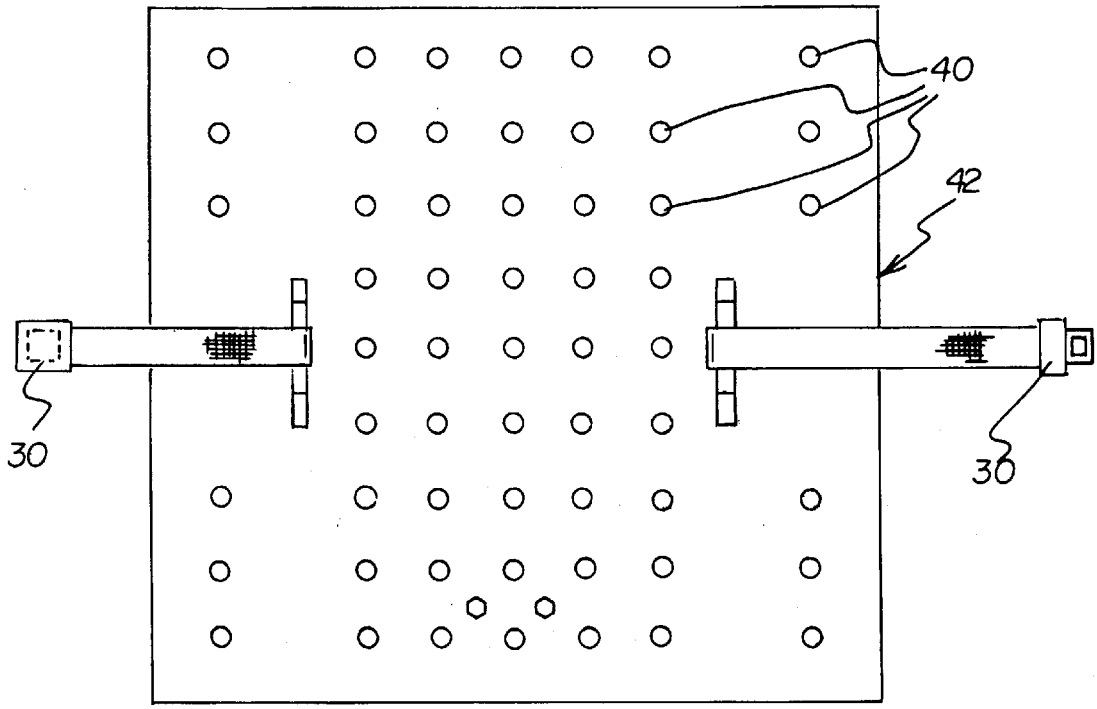

PORTABLE HOOP AND BACKGROUND ASSEMBLY

BACKGROUND OF THE INVENTION

1. Field of the Invention

The present invention relates to a basketball assembly and more particularly pertains to a new Portable Hoop and Backboard Assembly which allows the users of this Hoop and Baseboard assembly to easily install the assembly in selected places and then to optionally dissemble it after play has ceased.

2. Description of the Prior Art

The use of a portable basketball assembly is known in the prior art. More specifically, a portable basketball assembly heretofore devised and utilized are known to consist basically of familiar, expected and obvious structural configurations, notwithstanding the myriad of designs encompassed by the crowded prior art which have been developed for the fulfillment of countless objectives and requirements.

Known prior art a portable basketball assembly include U.S. Pat. No. 5,158,281; U.S. Pat. No. 4,973,054; U.S. Pat. No. 343,215; U.S. Pat. No. 4,145,044; U.S. Pat. No. 4,786,053 and U.S. Pat. No. 4,905,995.

While these devices fulfill their respective, particular objectives and requirements, the aforementioned patents do not disclose a new Portable Hoop and Backboard Assembly. The inventive device includes a backboard with bendable protrusions situated behind the backboard, straps for attaching the backboard, and a collapsible rim.

In these respects, the Portable Hoop and Background Assembly according to the present invention substantially departs from the conventional concepts and designs of the prior art, and in so doing provides an apparatus primarily developed for the purpose of providing a hoop and baseboard assembly that is easily installed and disassembled

SUMMARY OF THE INVENTION

In view of the foregoing disadvantages inherent in the known types of a portable basketball assembly now present in the prior art, the present invention provides a new Portable Hoop and Backboard Assembly construction wherein the same can be utilized for providing a hoop and baseboard assembly that is easily installed and disassembled The general purpose of the present invention, which will be described subsequently in greater detail, is to provide a new Portable Hoop and Backboard Assembly apparatus and method which has many of the advantages of the a portable basketball assembly mentioned heretofore and many novel features that result in a new Portable Hoop and Backboard Assembly which is not anticipated, rendered obvious, suggested, or even implied by any of the prior art a portable basketball assembly, either alone or in any combination thereof.

To attain this, the present invention generally comprises a backboard with bendable protrusions situated behind the backboard, straps for attaching the backboard, and a collapsible rim.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Portable Hoop and Backboard Assembly apparatus and method which has many of the advantages of the a portable basketball assembly mentioned heretofore and many novel features that result in a new Portable Hoop and Backboard Assembly which is not anticipated, rendered obvious, suggested, or even implied by any of the prior art a portable basketball assembly, either alone or in any combination thereof.

It is another object of the present invention to provide a new Portable Hoop and Backboard Assembly which may be easily and efficiently manufactured and marketed.

It is a further object of the present invention to provide a new Portable Hoop and Backboard Assembly which is of a durable and reliable construction.

An even further object of the present invention is to provide a new Portable Hoop and Backboard Assembly which is susceptible of a low cost of manufacture with regard to both materials and labor, and which accordingly is then susceptible of low prices of sale to the consuming public, thereby making such Portable Hoop and Background Assembly economically available to the buying public.

Still yet another object of the present invention is to provide a new Portable Hoop and Backboard Assembly which provides in the apparatuses and methods of the prior art some of the advantages thereof, while simultaneously overcoming some of the disadvantages normally associated therewith.

Still another object of the present invention is to provide a new Portable Hoop and Backboard Assembly for providing a hoop and baseboard assembly that is easily installed and disassembled Yet another object of the present invention is to provide a new Portable Hoop and Backboard Assembly which includes a backboard with bendable protrusions situated behind the backboard, straps for attaching the backboard, and a collapsible rim.

Still yet another object of the present invention is to provide a new Portable Hoop and Backboard Assembly that enables anyone to easily remove the assembly after use for a number of reasons, including to secure its safety.

Even still another object of the present invention is to provide a new Portable Hoop and Backboard Assembly that allows users to attach the assembly to any viable structure thus allowing the users a greater amount of flexibility as to where play may occur.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded isometric illustration of the present invention.

FIG. 4 is a rear elevation view of the backboard of an embodiment of the present invention.

DESCRIPTION OF THE PREFERRED EMBODIMENT

Figure 1:
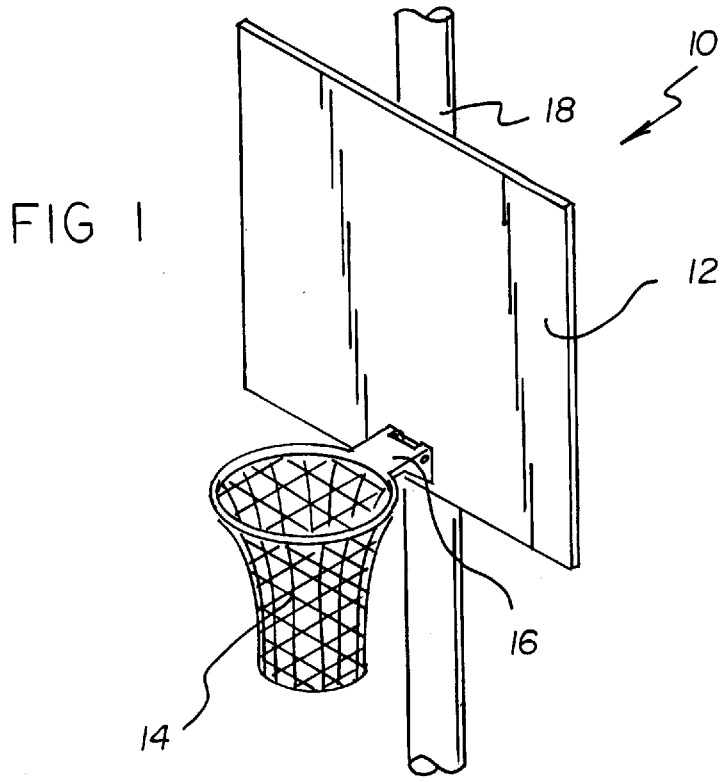
FIG. 1 is a right side perspective view of a new Portable Hoop and Backboard Assembly according to the present invention.
Figure 2:
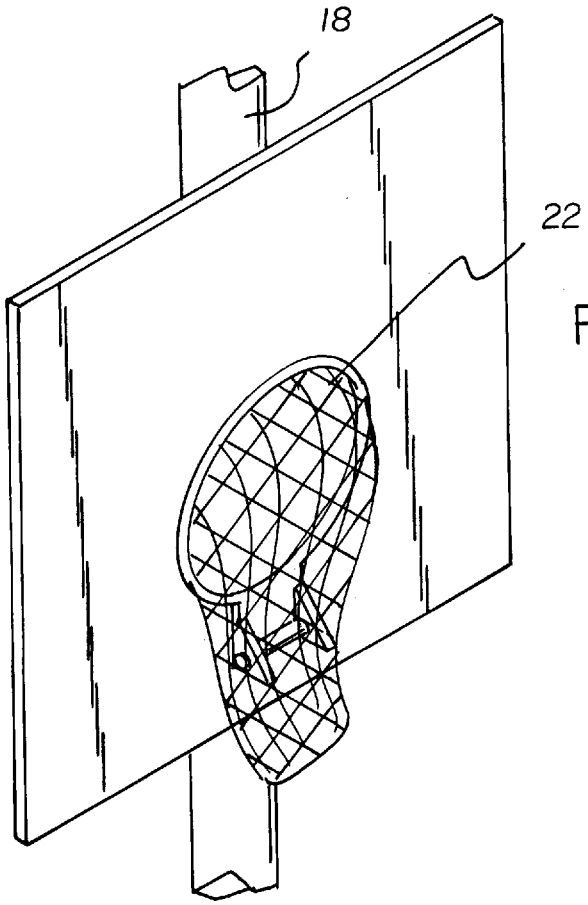
FIG. 2 is a perspective view of a collapsible rim embodiment.
Figure 5:
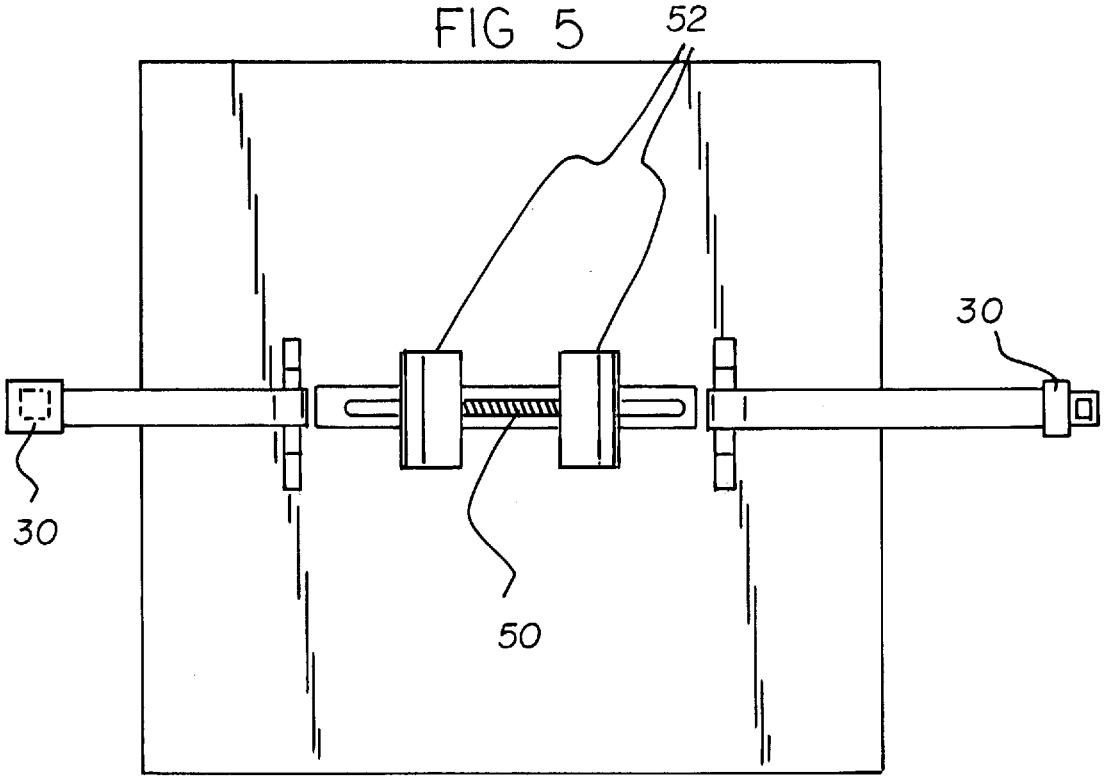
FIG. 5 is a rear elevation view of the backboard of an embodiment of the present invention.
Figure 6:
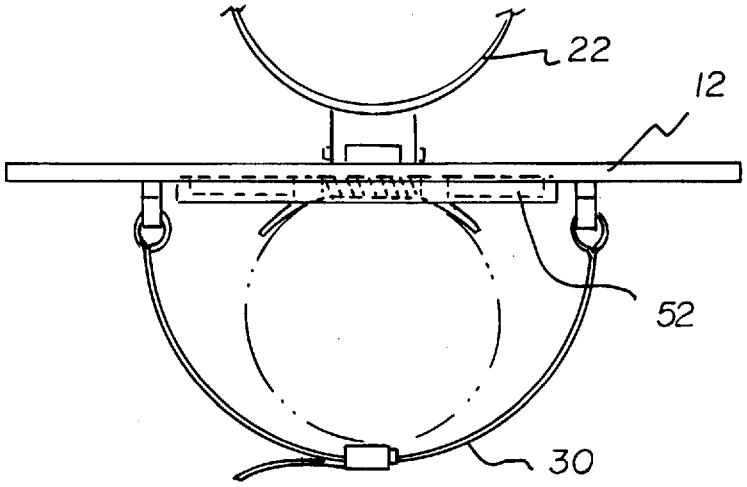
FIG. 6 is a cross sectional view of the present invention.

With reference now to the drawings, and in particular to FIGS. 1 through 6 thereof, a new Portable Hoop and Backboard Assembly embodying the principles and concepts of the present invention and generally designated by the reference numeral 10 will be described.

More specifically, it will be noted that the Portable Hoop and Backboard Assembly 10 comprises a lightweight portable backboard, means for attaching the backboard and a hoop and a collapsible rim.

As best illustrated in FIGS. 1 through 6, it can be shown that the Portable Hoop and Backboard Assembly of the present represents a novel and improved portable hoop and backboard assembly.

In use, the present invention includes a backboard 12, that may be square, rectangular or trapezoid shaped and which can be made of fiberglass or any such durable yet fairly light weight material and is held in position to any viable structure by way of strapping means 30. The strapping means 30 can be made of any suitable material including nylon. The strapping means 30 is of the kind that provides secure locking in place on structures such as poles, trees, porch railing and so forth and may of the kind such as automobile safety belts which can be adjusted and securely latched. In one embodiment, the backboard 12 has a back 42 which may be made up of a plurality of bendable protrusions 40. These bendable protrusions 40 are useful in grasping any angle or radius of the structure 18. These bendable protrusions 40 may be raised cylindrical protrusions that are about 1 inch in depth or may be any suitable protrusions that can provide the same type of gripping or insulating capabilities afforded by these cylindrical protrusions 40. These bendable protrusions 40 may be made of any bendable material such as rubber or plastic and may be attached to said back by a variety of means including but not limited to gluing them onto the backboard. Since the present invention may be attached to light poles, or telephone poles, the rubber or plastic protrusion backing 40 may serve as an insulation in these instances In another embodiment of the present invention, a spring means 50 and a sliding "U" clamp means 52 is used to grasp the structure to which the Portable Hoop and Backboard Assembly 10 is attached. The strapping means 30 would be used to tighten the grip on the pole and the like and the sliding clamp means 52 is used to stabilize the Portable Hoop and Backboard Assembly 10.

The net 14 is any suitable net that is available in the art. The net 14 is attached to the front of the backboard 12 by means of a collapsible means 16. The collapsible means 16 can be used to collapse the rim 22 of the net 14 so that it drops from its 90° angle to fit flush with the backboard. This allows the rim 22 to be more easily stored upon disassembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable hoop and background assembly comprising:

a backboard;

a rim disposed from a front of said backboard;

a net coupled to said rim;

strapping means attached to a back of said backboard;

wherein the rim of said net is collapsible;

a plurality of bendable protrusions positioned on said back of said backboard; and wherein said plurality of bendable protrusions are made of rubber or plastic.

2. The portable hoop and background assembly of claim 1, wherein said plurality of bendable protrusions are about 1 inch high.

3. The portable hoop and background assembly of claim 1, wherein said plurality of bendable protrusions are cylindrical in shape.

4. A portable hoop and background assembly comprising:

a backboard;

a rim disposed from a front of said backboard;

a net coupled to said rim;

strapping means attached to a back of said backboard;

wherein the rim of said net is collapsible;

wherein the back of said backboard has a plurality of bendable protrusions; and wherein said plurality of bendable protrusions are glued to the back of said backboard.

5. A portable hoop and background assembly comprising:

a backboard;

a rim disposed from a front of said backboard;

a net coupled to said rim;

strapping means attached to a back of said backboard;

wherein the rim of said net is collapsible; and a stabilizing means for stabilizing the backboard when installed, said stabilizing means including a pair of sliding U-shaped clamps and a biasing means for biasing said pair of U-shaped clamps towards each other.

6. A portable hoop and backboard assembly for attachment to a structure, said hoop and backboard assembly comprising:

a backboard;

a rim disposed from a front of said backboard at substantially a right angle to said backboard, said rim being collapsible to a storage position wherein said rim is positioned substantially parallel said backboard;

a net coupled to said rim;

an attachment means adapted for coupling said backboard to the structure, said attachment means being coupled to a back of said backboard;

a stabilizing means for stabilizing the backboard when installed, said stabilizing means including a pair of substantially vertical sliding U-shaped clamps and a biasing means for biasing said pair of U-shaped clamps towards each other such that said pair of U-shaped clamps are biased against opposite sides of the structure whereby the backboard is stabilized;

a plurality of flexible protrusions disposed from the back of said backboard, said plurality of flexible protrusions being adapted for gripping the structure when said backboard is coupled to the structure.

7. The hoop and backboard assembly of claim 6 wherein each of said plurality of flexible protrusions is constructed of a material selected from the group of materials consisting of rubber and plastic.

* * * * *